US008248438B2

(12) United States Patent
Kawabe

(10) Patent No.: US 8,248,438 B2
(45) Date of Patent: Aug. 21, 2012

(54) EL DISPLAY DEVICE FOR REDUCING PSEUDO CONTOUR

(75) Inventor: Kazuyoshi Kawabe, Yokohama (JP)

(73) Assignee: Global Oled Technology LLC, Wilmington, DE (US)

( * ) Notice: Subject to any disclaimer, the term of this patent is extended or adjusted under 35 U.S.C. 154(b) by 407 days.

(21) Appl. No.: 12/507,819

(22) Filed: Jul. 23, 2009

(65) Prior Publication Data

US 2010/0033408 A1 Feb. 11, 2010

(30) Foreign Application Priority Data

Aug. 7, 2008 (JP) ..... 2008-204703

(51) Int. Cl.
*G09G 5/10* (2006.01)

(52) U.S. Cl. ..... 345/690; 345/76; 345/82; 345/84; 345/204

(58) Field of Classification Search ..... 345/60, 345/63, 74.1, 75.1, 75.2, 76, 77, 80, 82, 83, 345/204–206, 690–694, 84; 250/552, 553; 313/498, 506, 512; 315/169.3
See application file for complete search history.

(56) References Cited

U.S. PATENT DOCUMENTS

| | | | | |
|---|---|---|---|---|
| 6,473,464 | B1 * | 10/2002 | Weitbruch et al. | 375/240.26 |
| 6,518,941 | B1 | 2/2003 | Kimura | |
| 7,206,005 | B2 * | 4/2007 | Yamashita et al. | 345/695 |
| 7,298,355 | B2 * | 11/2007 | Koyama | 345/92 |
| 7,339,557 | B2 * | 3/2008 | Ochi | 345/63 |
| 7,561,128 | B2 * | 7/2009 | Ahn et al. | 345/82 |
| 7,843,405 | B2 * | 11/2010 | Choi et al. | 345/63 |
| 7,903,129 | B2 * | 3/2011 | Inoue | 345/690 |
| 7,928,929 | B2 * | 4/2011 | Shishido et al. | 345/63 |
| 7,973,809 | B2 * | 7/2011 | Hosaka et al. | 345/690 |
| 2005/0212740 | A1 | 9/2005 | Miyagawa | |
| 2007/0030214 | A1 * | 2/2007 | Kim | 345/67 |
| 2007/0041446 | A1 * | 2/2007 | Seong et al. | 375/240.16 |
| 2008/0088561 | A1 | 4/2008 | Kawabe | |
| 2009/0309902 | A1 * | 12/2009 | Weitbruch et al. | 345/690 |

* cited by examiner

*Primary Examiner* — Lun-Yi Lao
*Assistant Examiner* — Tom Sheng
(74) *Attorney, Agent, or Firm* — McKenna Long & Aldridge LLP

(57) ABSTRACT

An organic EL display device capable of preventing generation of pseudo contours is provided. Digital data of pixels in one frame is stored in a frame memory, and display is performed according to the stored digital data. One frame is divided into a plurality of unit frames, each of which is divided into a plurality of sub-frames. In each of the sub-frames, display is performed for a bit corresponding to the digital data.

6 Claims, 9 Drawing Sheets

EL DISPLAY DEVICE FOR REDUCING PSEUDO CONTOUR

CROSS-REFERENCE TO RELATED APPLICATION

This application claims priority of Japanese Patent Application No. 2008-204703 filed Aug. 7, 2008 which is incorporated herein by reference in its entirety.

FIELD OF THE INVENTION

The present invention relates to a display device which stores digital data of respective pixels for one frame in a frame memory, and performs display according to the stored digital data.

BACKGROUND OF THE INVENTION

Organic EL displays have been developed actively in recent years. This is because an organic EL, which is a self-emissive element, is advantageous in realizing high contrast which is thought to be limited in a liquid crystal display (LCD). Further, as an organic EL element provides a high-speed response, moving images involving dynamic movements can be displayed without blurs, so that an excellent display performance can be achieved.

Currently, active-matrix type displays, in which organic EL elements are driven by thin film transistors (TFT), are becoming mainstream. These displays are fabricated by forming organic EL elements on a substrate provided with a low-temperature polysilicon TFT and the like thereon. Although a low-temperature polysilicon TFT is often used as a driving element of organic EL because it exhibits high mobility and stable operation, it involves large variations in characteristics such as a threshold and mobility. When a low-temperature polysilicon TFT is driven with a constant current in a saturated region, the brightness varies among pixels, causing a problem of non-uniform appearance on the display. As such, there has been disclosed digital drive in which a TFT is operated in a linear region and used as a switch to thereby reduce non-uniformity in display.

Further, in digital driving, as pixels are controlled by two values of whether to be lit-up or extinguished, multi-gradation can be realized by way of a plurality of sub-frames (sub-frame type digital driving) or by way of area gradation using a plurality of sub-pixels (sub-pixel type digital driving).

In the conventional digital drive of sub-frame type, a pseudo contour is easily generated, and in particular, it is difficult to suppress a pseudo contour generated by a high-speed eye movement in a still image. Further, as the screen becomes larger and has higher resolution, it has been difficult to introduce a sufficient number of sub-frames.

Furthermore, although a pseudo contour is not generated in conventional digital drive of sub-pixel type, a large number of sub-pixels cannot be introduced in a unit pixel, making it disadvantageous from the viewpoint of multi-gradation, and making it difficult to improve the picture quality.

SUMMARY OF THE INVENTION

In accordance with the present invention, there is provided an organic EL display for displaying a frame having reduced pseudo contour, comprising:

(a) a plurality of pixels, each including a driving transistor, an organic EL element driven by the driving transistor, and a storage capacitance connected to the driving transistor;

(b) a plurality of gate lines, each connected to one or more corresponding pixel(s), a plurality of data lines, each connected to one or more corresponding pixel(s), a gate driver for selectively driving the plurality of gate lines, and a data driver for selectively driving the plurality of data lines, wherein each pixel is connected to a single data line and to a single gate line, the gate driver selects one gate line at a time, and pixel data from the data driver on a single data line is written to the storage capacitance in the pixel connected to the single data line and to the selected gate line;

wherein pixel data includes an off-potential or an on-potential, so that on-potential pixel data written to a pixel causes the corresponding organic EL element to emit light, and off-potential pixel data written to a pixel causes the light emission from the corresponding organic EL element to be extinguished;

and wherein the storage capacitance causes the one or more organic EL element(s) in pixels attached to non-selected gate lines to maintain their respective light emission state(s);

(c) a frame memory for storing pixel data corresponding to one frame and providing the stored pixel data to the data driver; and (d) means for operating the gate driver and the data driver to display the stored pixel data corresponding to one frame in a plurality of successive unit frames, each including a corresponding plurality of successive sub-frames, wherein each unit frame has a number of sub-frames greater than or equal to a respective bit gradation number, and wherein each sub-frame corresponds to a bit of pixel data;

whereby the one frame is displayed with reduced false contour.

A display device, according to an aspect of the present invention, stores digital data of respective pixels for one frame in a frame memory, and performs display according to the stored digital data. One frame is divided into a plurality of sub-frames, and in each of the sub-frames, display is performed for a bit corresponding to the digital data, and display of a unit frame for one frame, performed in this manner, is repeated for a display period of one frame.

It is preferable that data corresponding to the upper bit of the digital data in the sub-frame is divided into a plurality of pieces which are arranged in a distributive manner in the sub-frames of one frame.

It is also preferable that a plurality of sub-pixels is introduced for each pixel, and that a bit of the digital data displayed in each of the sub-pixels is allocated to the sub-pixels.

It is also preferable that power supply lines for supplying driving current to the sub-pixels are respectively provided, and that the power supply voltages thereof are set to be different.

It is also preferable that in a display period of one frame, display of the same unit frame is repeated a plurality of times.

It is also preferable that when display of a unit frame is repeated a plurality of times in the display period of one frame, bit data to be displayed and bit data before or after thereof are changed by a unit frame.

It is also preferable that when display of a unit frame is repeated a plurality of times in the display period of one frame, display of each unit frame is changed according to a motion vector acquired from display contents of frames.

It is also preferable that each pixel includes a self-emissive light-emitting element.

According to the present invention, by performing display for one frame a plurality of times in the display period of one frame, generation of a pseudo contour can be prevented and the number of gradations can be easily increased.

DETAILED DESCRIPTION OF THE INVENTION

Hereinafter, an embodiment of the present invention will be described based on the drawings.

Figure 1:
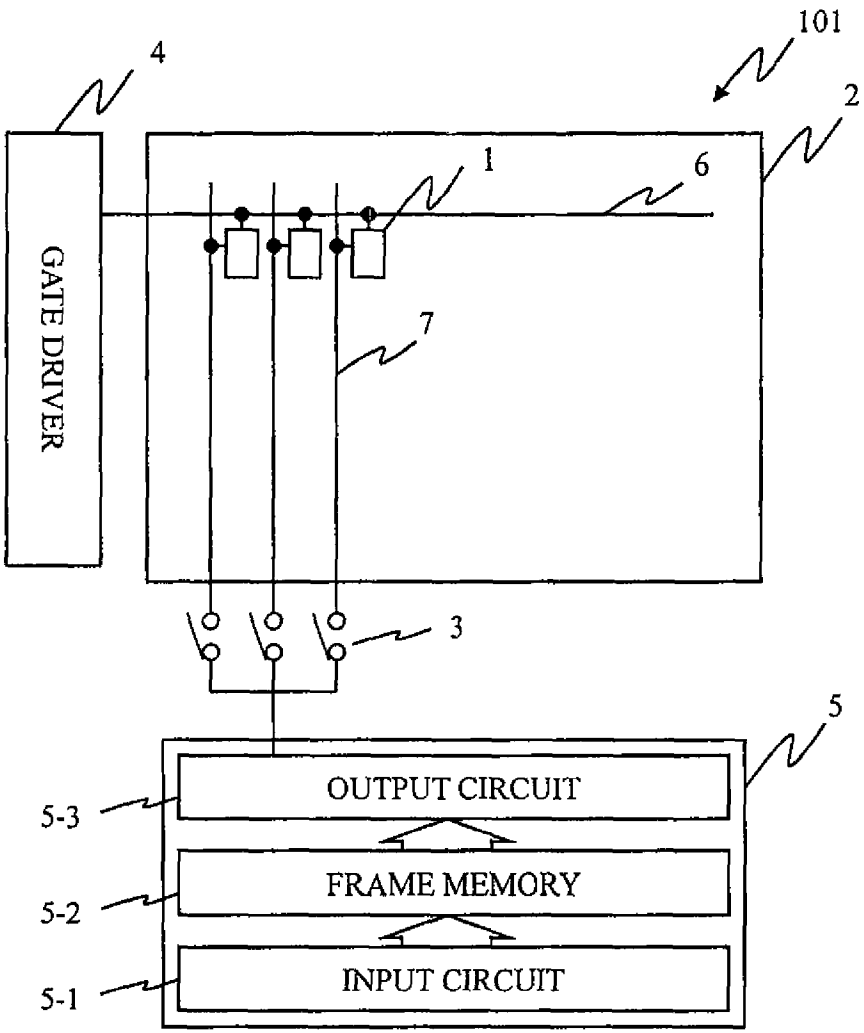
FIG. 1 is a diagram showing the overall configuration of a display device according to an embodiment.

FIG. 1 shows the overall configuration of a display device 101 according to the present embodiment. The display device 101 includes a pixel array 2 in which pixels 1 are arranged in a matrix, each of the pixels emitting any color of R (red), G (green), and B (blue), a gate driver 4 which selectively drives a plurality of gate lines 6, a data driver 5 which drives a plurality of data lines 7, and a multiplexer 3 which selectively connects an output of the data driver to any one of the data lines 7 of R, G, and B. The pixel 1 becomes a full-color unit pixel using three pixels of R, G, and B, which permits full-color display. In this example, the device includes the data lines 7 for respective colors of R, G, and B. The pixels 1 of the corresponding colors are disposed along the data lines of the respective colors, and data of each color is supplied to the corresponding data line 7 by the multiplexer 3. A pixel 1 emitting W (white) can also be introduced besides the RGB pixels to thereby constitute a full-color unit pixel of RGBW. In that case, a data line for W is additionally introduced, and the multiplexer 3 can select the data line 7 of W as well.

The data driver 5 shown in FIG. 1 includes an input circuit 5-1, a frame memory 5-2, and an output circuit 5-3, and operates as a data driver with a built-in memory. Data of dot units input from the outside is input into the input circuit 5-1, converted into data of line units, and stored in the frame memory 5-2. The data stored in the frame memory 5-2 is read out in line units and transferred to the output circuit 5-3. The output circuit 5-3 is connected with the data lines 7 via the multiplexer 3. When the multiplexer 3 selects R, G, and B in this order, for example, the respective data lines 7 of R, G, and B are connected to the output circuit 5-3 in sequence. Thereby, pieces of data of respective colors are output, in line units, to the data lines 7 of the corresponding colors in the order of R, G, and B.

In this way, with the multiplexer 3, as the required output number of the data drivers 5 is only the number of full-color unit pixels (one for three pixels of RGB), the configuration is simplified, so this configuration is often used for portable terminals. For instance, in the case of QVGA of 240*320, the number of outputs of the data driver 5 is 240, so the circuit size of the output circuit 5-3 can be minimized, which is advantageous in cost reduction. If the multiplexer 3 is omitted, as outputs of the data driver 5 must be connected to all of the data lines 7 of RGB, outputs numbering 240*3=720 are required.

The gate driver 4 selects a gate line 6 for outputting data immediately before the data is output to the data line 7. Thereby, the data from the data driver 5 is written properly to the pixel 1 on the corresponding line. When the data is written to the pixel 1, the gate driver 4 releases selection of the corresponding line 4, and then selects a line which should be selected next, and repeats selection and release in this manner. In other words, the gate driver 4 should be operated to select only one line at a time.

Figure 2:
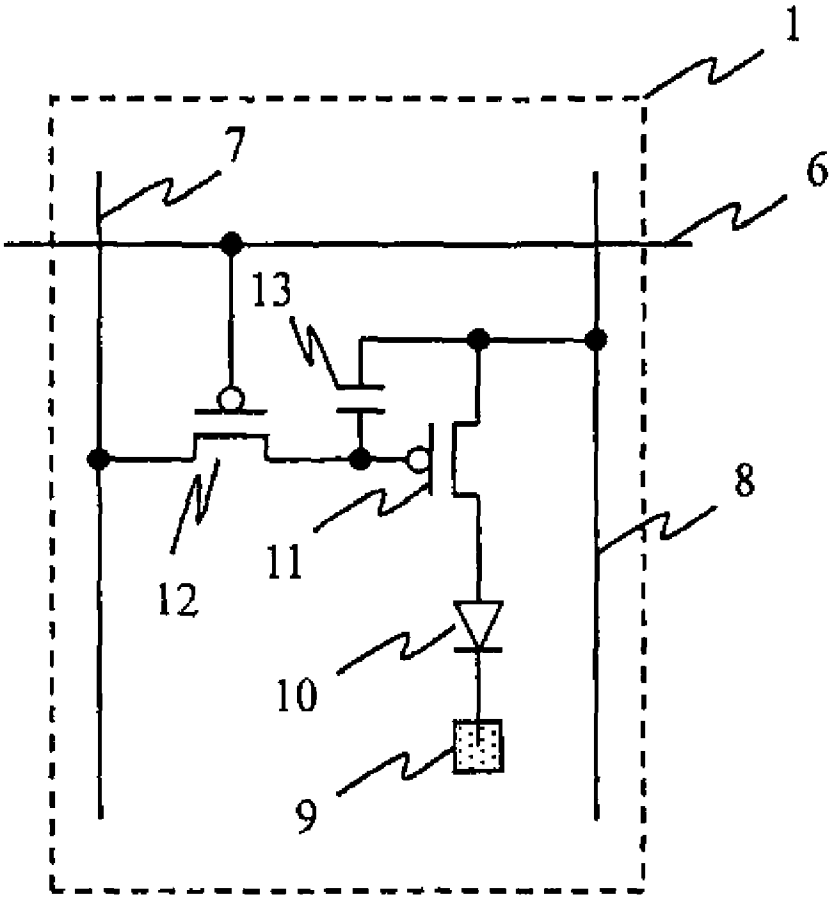
FIG. 2 shows the configuration of a pixel circuit.

As shown in FIG. 2, the pixel 1 includes an organic EL element 10, a driving transistor 1, a selection transistor 12, and a storage capacitance 13. The anode of the organic EL element 10 is connected to a drain terminal of the driving transistor 11, and the cathode thereof is connected to a cathode electrode 9 shared by all pixels. A source terminal of the driving transistor 11 is connected to a power supply line 8 shared by all pixels, and a gate terminal thereof is connected to the other end of the storage capacitance 13 connected to the power supply line 8, and to a source terminal of the selection transistor 12. Further, a gate terminal of the selection transistor 12 is connected to the gate line 6, and a drain terminal thereof is connected to the data line 7. It should be noted that the power supply line 8 and the cathode electrode 9 are not shown in FIG. 1.

When the gate line 6 is selected (turned to low) by the gate driver 4, the selection transistor 12 is made to conduct, and the data potential supplied to the data line 7 is directed to the gate terminal of the driving transistor 11 to thereby control on/off of the driving transistor 11. For example, when the data potential on the data line 7 is low, the driving transistor 11 is made to conduct, so that a current flows into the organic EL element 10 and the organic EL element 10 emits light. In contrast, when the data potential is high, the driving transistor 11 is off, so that no current flows into the organic EL element and the light is extinguished. As the data potential directed to the gate terminal of the driving transistor 11 is stored in the storage capacitance 13, even if the selection transistor 12 is not selected by the gate driver 4 (even if it becomes high), on/off operation of the driving transistor 11 is maintained, and the organic EL element 10 maintains a lit-up state or an extinguished state until it is accessed again.

Figure 3:
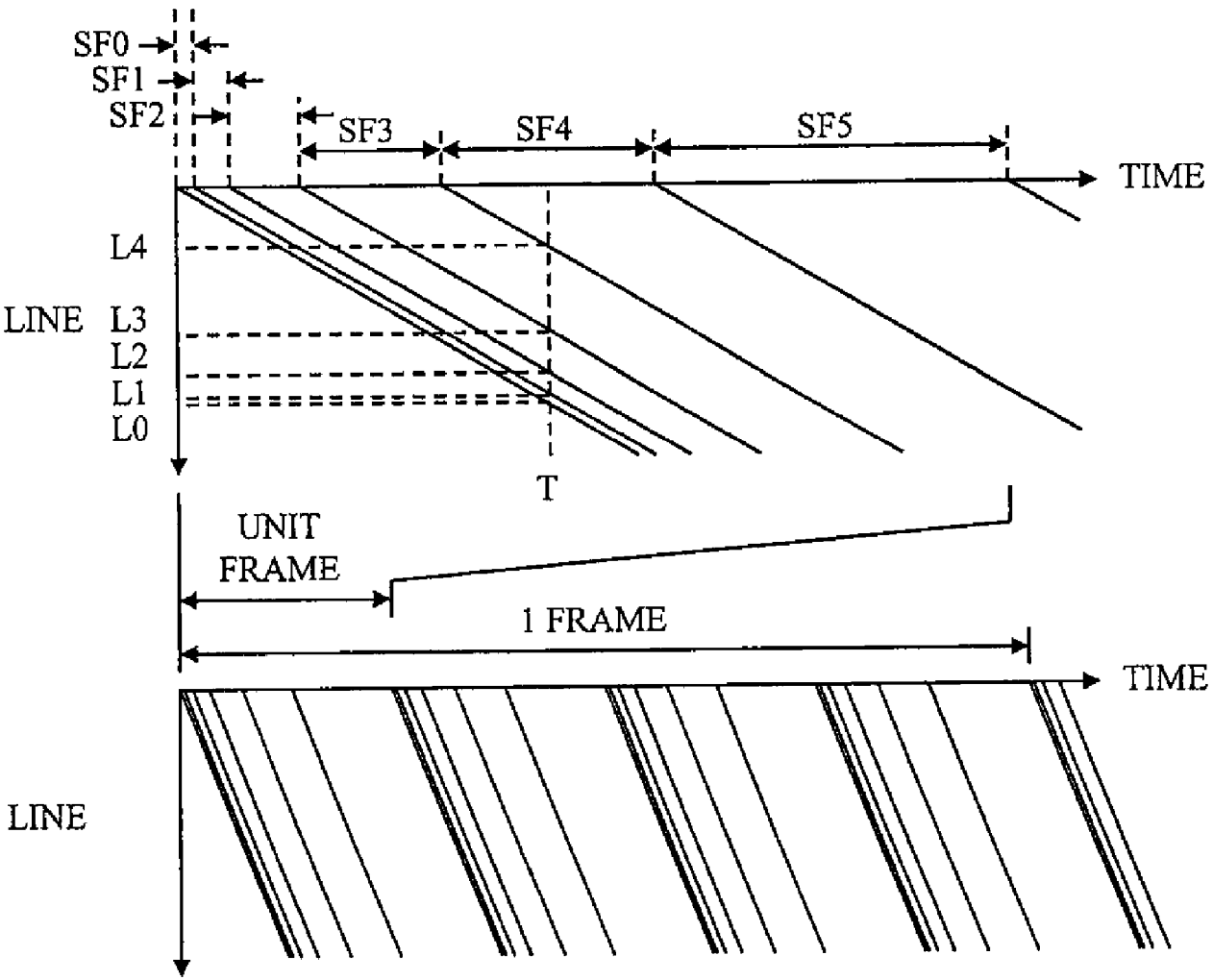
FIG. 3 shows a display sequence using sub-frames.

FIG. 3 shows a sub-frame configuration of digital driving according to the present embodiment. Although an example of 6-bit gradation display is shown, in order to simplify the description, it is obvious that the same concept can be applied to 8-bit gradation and 10-bit gradation.

The upper part of FIG. 3 shows a sub-frame configuration for a unit frame period enabling 6-bit gradation display by way of six sub-frames (SF0 to SF5). In other words, 6-bit gradation can be displayed only with unit sub-frames. The sub-frames start with the lower bit SF0, and when the upper bit SF5 ends, 6-bit display is performed. It should be noted that the order of the sub-frames is not necessarily from the lower bit to the upper bit. They can be in order from the upper bit to the lower bit, or in random order.

When performing scanning as shown in the upper part of FIG. 3 using the display device shown in FIG. 1, it is necessary to select a plurality of lines (horizontal lines) L0 to L4 in a time-divided manner in a period T, and to control bit data so as to be written onto lines corresponding thereto. That is, in the period T, it is necessary to select gate lines in a time-divided manner and supply corresponding data such that data of bit 0 is written onto the line L0, data of bit 1 is written onto the line L1, data of bit 2 is written onto the line L2, data of bit 3 is written onto the line L3, and data of bit 4 is written onto the line L4. As an example of the controlling method of this kind is described in detail in U.S. Patent Application Publication No. 2008-0088561.

If the unit frame period shown in the upper part of FIG. 3 is one-quarter of the frame period, four unit frames are introduced in one frame period as shown in the lower part of FIG. 3. If the frequency of one frame period is 60 Hz, in the case shown in the lower part of the FIG. 3, 6-bit gradation display is performed at 240 Hz (4× speed). As described above, if the same image is repeatedly displayed within one frame period, flicker is reduced and a pseudo contour becomes less prominent. The reasons for this will be described below with use of FIGS. 4A, 4B, 5A, and 5B.

Figure 4A:
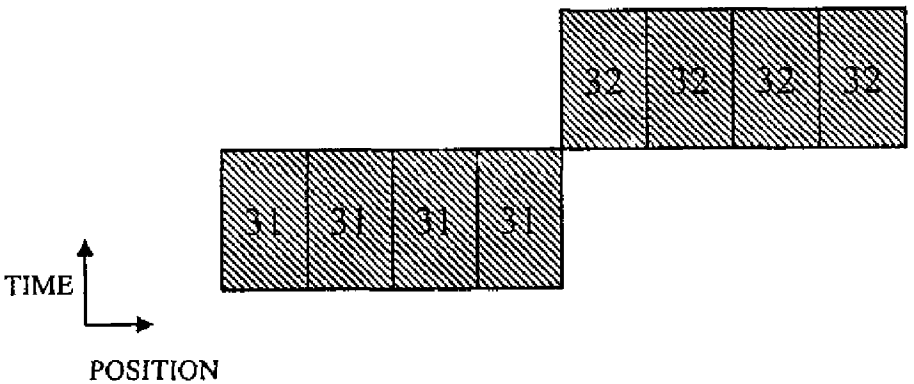
FIG. 4A illustrates a displaying state of typical one-frame display.
Figure 4B:
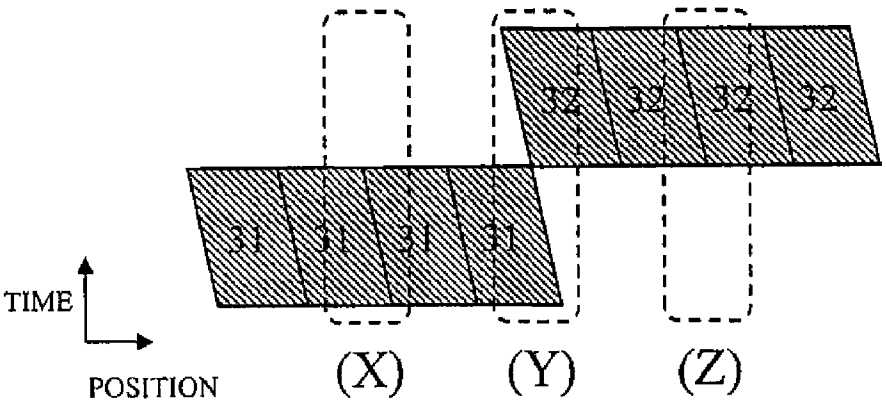
FIG. 4B illustrates a displaying state in which display is repeated a plurality of times in a display period of one frame.
Figure 5A:
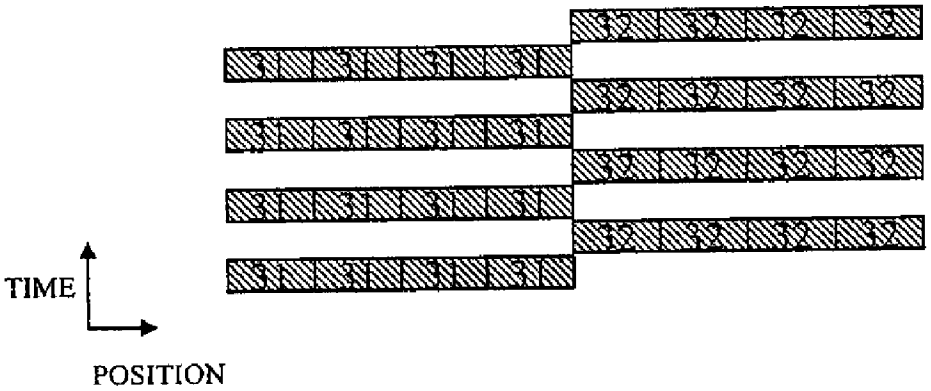
FIG. 5A illustrates a displaying state of typical one-frame display.
Figure 5B:
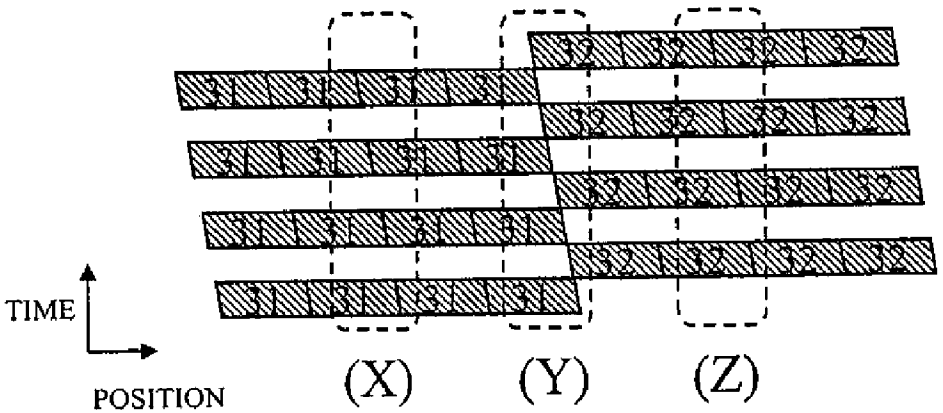
FIG. 5B illustrates a displaying state in which display is repeated a plurality of times in a display period of one frame.

FIGS. 4A and 4B show an example of performing digital driving of 6-bit gradation at 60 Hz, in which the vertical axis indicates time and the horizontal axis indicates pixel positions or luminous positions. As shown in FIG. 4A, a pseudo contour becomes prominent when luminescence of data "31" and luminescence of data "32" by sub-frames are adjacent to each other. As shown in the upper part of FIG. 3, when the data "31" is luminous, all of the sub-frames SF0 to SF4 are lit up, which is in the first half of the frame period. However, when the data "32" is luminous, only the sub-frame SF5 is lit up, which is in the second half of the frame period as shown in FIG. 4A. In this state, when an image moves from right to left and the eyes follow the image so that the eye sight moves, the image appears in a different manner as shown in FIG. 4B from the state where the image does not move as shown in FIG. 4A. How the displayed data is seen when the image moves is that at an observing point X in FIG. 4B, luminescence of the data "31" is observed to be the same as the case of FIG. 4A, and at an observing point Z, luminescence of the data "32" is observed to be the same as the case of FIG. 4A. However, the situation differs at an observing point Y. A part of the luminescence of the data "32" which is luminous in the second half of the frame period overlaps the luminescence of the data "31" which is luminous in the first half of the frame period, the overlapped portion looks as brighter by almost two times at maximum, and a contour line which is never present in the image is perceived. As the overlapped portion becomes larger with the movement of the image becoming faster, the pseudo contour becomes prominent. In view of this fact, when display is performed at a higher speed such as 4× speed of 240 Hz, the moving image appears in a different way, as shown in FIGS. 5A and 5B. That is, as the unit frame period becomes one-quarter, at the observing point Y in FIG. 5B, the overlapped portion between the data "31" and the data "32" caused by eye movement is reduced, and fluctuation of the luminous intensity is suppressed.

As movement of a typical moving image is not so fast, the pseudo contour can be reduced at 75 Hz to 150 Hz as described in U.S. Pat. No. 6,518,941. Rather, an effect of a pseudo contour due to eye movement when viewing a still image is larger. That is, in the case where the data "31" and the data "32" as shown in FIGS. 4A and 4B are adjacent to each other, when viewing a still image while moving the eyes from left to right, a state shown in FIG. 4B is caused, so that a pseudo contour is perceived. Such a situation is easily caused in a display used in a mobile terminal or the like. When the terminal is shaken, a relative velocity is easily caused in the eyes and in the luminescence, and as the velocity is fast, a pseudo contour is easily perceived. In order to solve the problem of pseudo contour, it is understood from FIGS. 5A and 5B that the pseudo contour suppressing effect becomes higher if displaying is performed at 4× speed (240 Hz) or higher, that is, 5× speed (300 Hz) or 8× speed (480 Hz), for example. According to experimentation performed by the inventor, in the case of 3× to 4× speed (180 Hz to 240 Hz), the pseudo contour generated when the display is shaken was reduced to a permissible level. Regarding the number of x-speed and the frequency, it is not necessary to be an integral multiple such as 3× and 4×. It has been known that the same effect can be achieved by setting to be a real number multiple such as 3.2× (192 Hz) and 3.8× (228 Hz). Although the frame rate of an output image can be synchronized with the frame rate of an input image in the case of integral multiplication, both cannot be synchronized with each other in the case of real number multiplication. If an image is displayed at 3× speed or higher, the same image is repeatedly displayed for 3 times or more in one frame period, so that the moving image is displayed smoothly without the frame rates being synchronized.

Further, the sub-frame SF5 having a long illumination period can be divided into some sub-frames such as SF5-1 and SF5-2 to thereby avoid overlapping of illumination periods by eye movement shown in FIGS. 4A and 4B. For example, if the sub-frames SF5-1 and SF5-2 have the same period, the data "32" of the sub-frame SF5 is divided into two pieces of data "16". Therefore, as the data "32" can be indicated as data "16" of sub-frames SF0 to SF4 and data "16" of the sub-frame SF5-1, overlapping of luminescence caused by eye movement between the data "31" and the data "32" can be reduced. The sub-frame SF5 can be divided into three or four sub-frames, and the dividing ratio can also be set in various ways.

Figure 6:
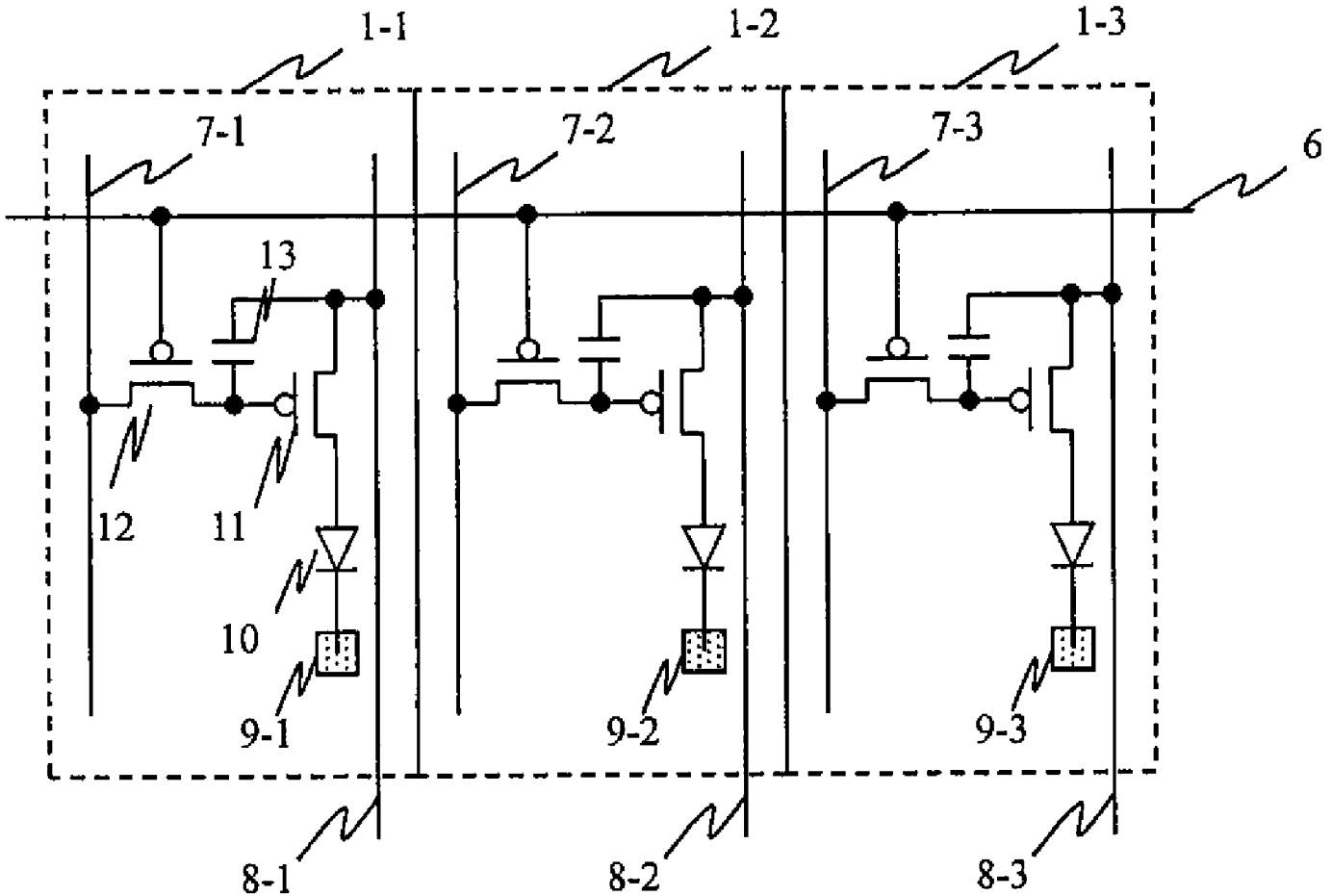
FIG. 6 shows pixel circuits in the case of using sub-pixels.

However, if the screen size increases and the resolution becomes higher, 4×-speed driving for suppressing a pseudo contour becomes more difficult. As such, sub-pixels can be introduced within one pixel as shown in FIG. 6. FIG. 6 shows an example in which the pixel 1 is used as a sub-pixel, and three sub-pixels aligned in a line constitute one pixel while sharing the gate line 6. A sub-pixel 1-1 produces a luminous intensity corresponding to data of the upper bit, a sub-pixel 1-2 produces a luminous intensity corresponding to data of the intermediate bit, and a sub-pixel 1-3 produces a luminous intensity corresponding to data of the lower bit. In order to obtain different luminous intensities among sub-pixels, the luminous areas of the organic elements 1-1, 1-2, and 1-3 of the respective sub-pixels can vary. However, a configuration capable of adjusting the luminous intensity by providing different power source lines to the respective sub-pixels as shown in FIG. 6 to thereby supply different power supply potential, that is, supplying VDD1 to a power supply line 8-1 of the sub-pixel 1-1, VDD2 to a power supply line 8-2 of the sub-pixel 1-2, and VDD3 to a power supply line 8-3 of the sub-pixel 1-3, is more preferable. For example, in order to realize 12-bit gradation display with three sub-pixels, each sub-pixel is required to produce gradation of 12/3=4 bits. However, as the sub-pixel 1-1 corresponding to the upper bits corresponds to bits 11 to 8 which are the upper 4 bits among the 12 bits, the sub-pixel 1-2 corresponding to the intermediate bits corresponds to bits 7 to 4 which are the next 4 bits, and the sub-pixel 1-3 corresponding to the lower bits corresponds to bits 3 to 0 which are the remaining lower 4 bits, the luminous intensity ratio with respect to the same illumination period must be set to be 256:16:1. From the point of accuracy, it is difficult to realize the luminous intensity ratio of 256:1 at maximum by way of luminous area ratio, and once the device is produced, no adjustment can be made. As such, the luminous intensity ratio is adjustable easily and accurately with the configuration in which power supply potential can be set for each sub-pixel, as shown in FIG. 6.

The sub-pixels select the same gate line 6, and one of the pieces of bit data of the upper 4 bits, the intermediate 4 bits, and the lower 4 bits is supplied to each of the data lines 7-1, 7-2, and 7-3 of the sub-pixels, so that the bit data is written simultaneously into the three sub-pixels. For example, when the sub-frame SF2 of the bit 2, among the upper 4 bits, the intermediate 4 bits and the lower 4 bits, is started, the pieces of data of the upper bit 2 (bit 10), of the intermediate bit 2 (bit 6), and of the lower bit 2 (bit 2) are supplied to the data lines 7-1, 7-2, and 7-3, respectively, and are written into the sub-pixels.

Figure 7:
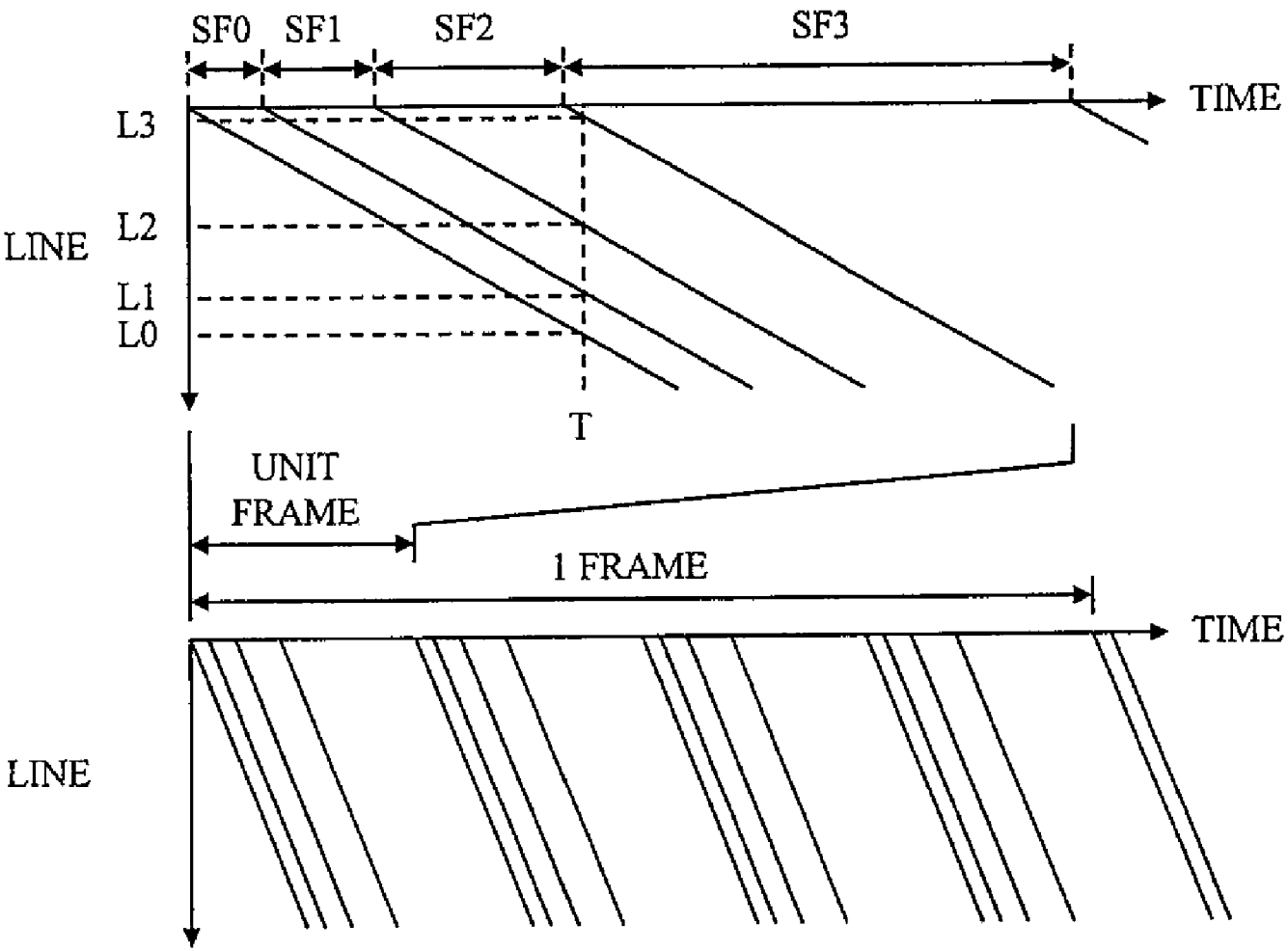
FIG. 7 shows a display sequence using sub-frames and sub-pixels.

FIG. 7 shows an example of a sub-frame structure for performing 12-bit gradation display using the pixels shown in FIG. 6. As described above, the sub-pixels include SF0 to SF3 of 4-bit gradation, that is, sub-frame periods of 1:2:4:8. The upper part of FIG. 7 shows a unit frame capable of displaying 4-bit gradation, and the unit frame is repeated four times in one frame period as shown in the lower part of FIG. 7, whereby a pseudo contour is suppressed. Even in this case, the lines L0 to L3 are selected in a time-divided manner in the period T as shown in FIG. 3, and the lines are controlled such that bit 0 is written onto the line L0, bit 1 is written onto the line L1, bit 2 is written onto the line L2, and bit 3 is written on the line L3.

As is clear from comparison between FIG. 3 and FIG. 7, a larger amount of bit data can be transferred by introducing sub-pixels while sharing the gate line as shown in FIG. 6, whereby multi-gradation can be realized with a smaller number of sub-frames. In that case, even with 4×-speed driving, 12-bit gradation can be produced by 16 sub-frames. If an attempt is made to realize this with a single pixel, 12*4=48 sub-frames are required, which is three times larger than that shown in FIG. 7.

As a display with higher resolution has a larger number of lines, a time for selecting one line is required to be reduced. However, as the wiring load is increased in a larger screen, a time for selecting one line cannot be reduced. As such, in a larger display with higher resolution, as it is difficult to increase the number of sub-frames, it is extremely difficult to produce 4×-speed 12-bit gradation by introducing 48 sub-frames. However, as it is possible to realize 4×-speed 12-bit gradation with 16 sub-frames by introducing three sub-pixels, a larger display with higher resolution can be driven sufficiently.

If it is impossible to introduce three sub-pixels, two sub-pixels can suffice. If dividing the bit data into two pieces of data of upper bits and lower bits in which a sub-pixel 1-1 corresponds to the upper 4 bits and a sub-pixel 1-2 corresponds to the lower 4 bits, 8-bit gradation can be realized with 16 sub-frames (4 sub-frames in one unit frame).

If four sub-frames can be introduced, as data can be divided into four pieces, that is, upper bits, upper-intermediate bits, lower-intermediate bits, and lower bits, 12-bit gradation can be realized with 12 sub-frames (3 sub-frames in one unit frame).

As shown in FIGS. 3 and 7, the sub-frame structures of unit frames continuing from the first, the second, and so on are not necessarily the same, and can be different. For example, the number of gradations can vary such that a first unit sub-frame has 6 bits and a second unit sub-frame has 8 bits, or the periods of sub-frames SF0 to SF5 of the first unit frame can vary in respective unit frames.

Figure 8:
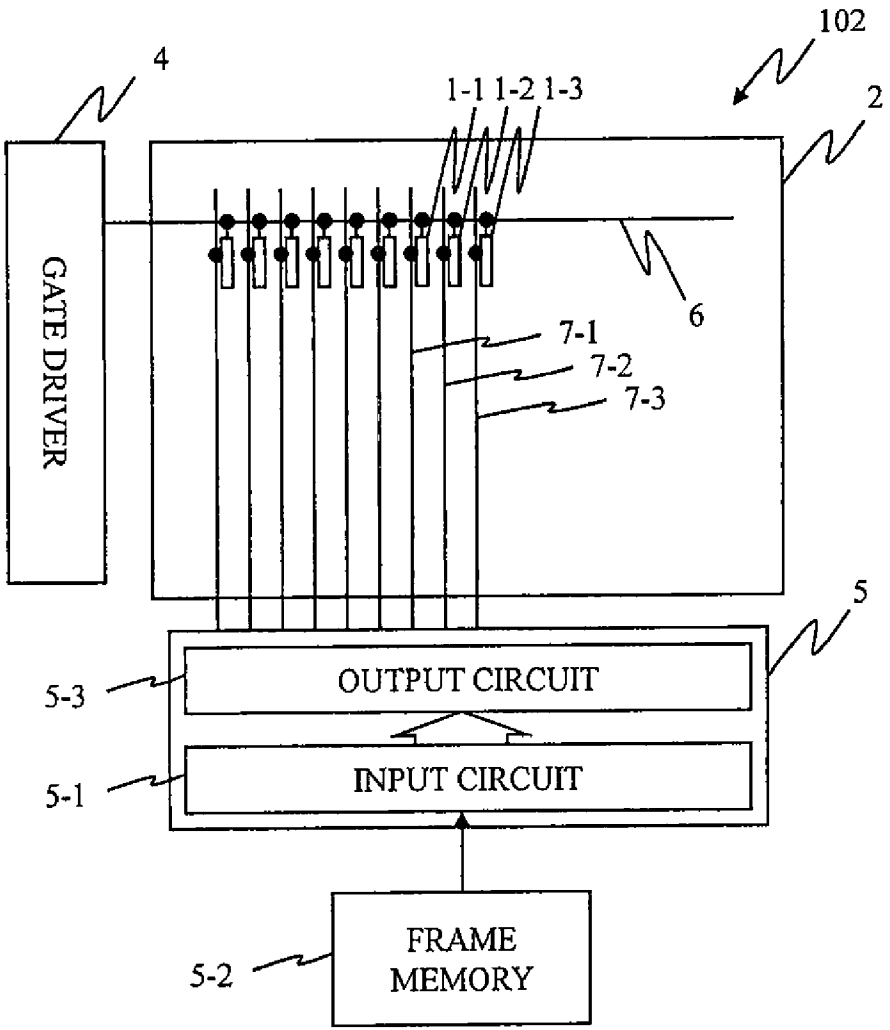
FIG. 8 is a diagram showing the overall configuration of a display device according to an embodiment using sub-pixels.

FIG. 8 shows the overall configuration of a display device 102 in which the pixels shown in FIG. 6 are introduced. As the constitutional elements denoted by the same reference numeral operate in the same manner as those in FIG. 1, the explanation is not repeated. In the display device 102, as three sub-pixels 1-1 to 1-3 are introduced in a unit pixel, data lines 7-1 to 7-3 corresponding thereto are present, and the number thereof is three time as large as that of the display device 101. As such, the number of outputs of the data driver 5 must correspond thereto.

As the display device 102 is assumed to be large, the multiplexer 3 introduced in the display device 101 is omitted. If the multiplexer 3 is used, high-speed driving cannot be performed due to ON resistance of the multiplexer 3. As such, the data lines 7-1 to 7-3 are directly connected to the outputs of the data driver 5. Therefore, outputs of the data driver 5 are secured for the number corresponding to the data lines 7-1 to 7-3 of RGB. For example, in the case of fill high-definition, as the horizontal resolution is 1920, the number of outputs of the data driver 5 is 1920*3(RGB)*3=17280. As it is not typical to provide such a number of outputs with one driver IC, they are provided by a plurality of ICs. For example, in the case of a driver IC having 720 outputs, 24 drivers are used.

As the data driver 5 is a simple digital circuit including an output circuit 5-3 having outputs in the same number as that of the data lines of the display array 2 and an input circuit 5-1 which converts data of dot units input to the data driver into data of line units, the data driver 5 can be realized at a lower cost even if the number of outputs becomes three times larger. Further, as the frame memory is provided outside the data driver 5, a low-cost general-purpose memory can be used. If a frame memory can be introduced into the data driver 5 at a low cost, a data driver with a built-in memory as shown in FIG. 1 can be used.

The data of dot units input from the outside is first stored in the frame memory 5-2, and when a sub-frame is started as shown in FIG. 7, bit data corresponding thereto is read and input into the data driver 5. In the case of 12-bit data for example, when the sub-frame SF2 is started, data of bit 10, data of bit 6, and data of bit 2 to be written into respective sub-pixels of the corresponding lines are read from the frame memory 5-2, and transferred to the input circuit 5-1. The input circuit 5-1 stores the data of respective sub-pixels, input by dot units, for one line, converts the data into line data, and transfers the data to the output circuit 5-3. The output circuit 5-3 supplies the line data from the input circuit 5-1 to the data lines 7-1 to 7-3 of respective sub-pixels in line units, and in a pixel of the line selected by the gate driver 4, bit date corresponding to the sub-frame is written. That is, data of bit 10, data of bit 6, and data of bit 2 of the sub-frame SF2 are written into the sub-pixels 1-1, 1-2, and 103, respectively. By repeating this operation for each sub-frame and performing 4×-speed driving, multi-gradation can be realized while suppressing a pseudo contour.

By applying 4×-speed driving, more gradation can be achieved. For example, in the case of generating 6-bit gradation by a unit frame as shown in FIG. 3, 8-bit gradation can be produced by performing 4×-speed driving and displaying different data for respective unit frames. In that case, it suffices that data "n" and data "n+1" are switched in each unit frame. If the data "n" is displayed in the first, second, and third unit frames, and the data "n+1" is displayed in the fourth frame, $n+1/4^{th}$ gradation can be displayed. If the data "n" is displayed in the first and third unit frames and the data "n+1" is displayed in the second and fourth unit frames, $n+1/2^{th}$ gradation can be displayed. If the data "n" is displayed in the first unit frame and the data "n+1" is displayed in the second, third, and fourth unit frames, $n+3/4^{th}$ gradation can be displayed. The sequential order of unit frames for displaying the data "n" and the data "n+1" is not specifically limited. They can be in different orders in adjacent pixels. Further, the pieces of data displayed alternately are not necessarily consecutive data. They can be data "n" and data "n+2".

Figure 9:
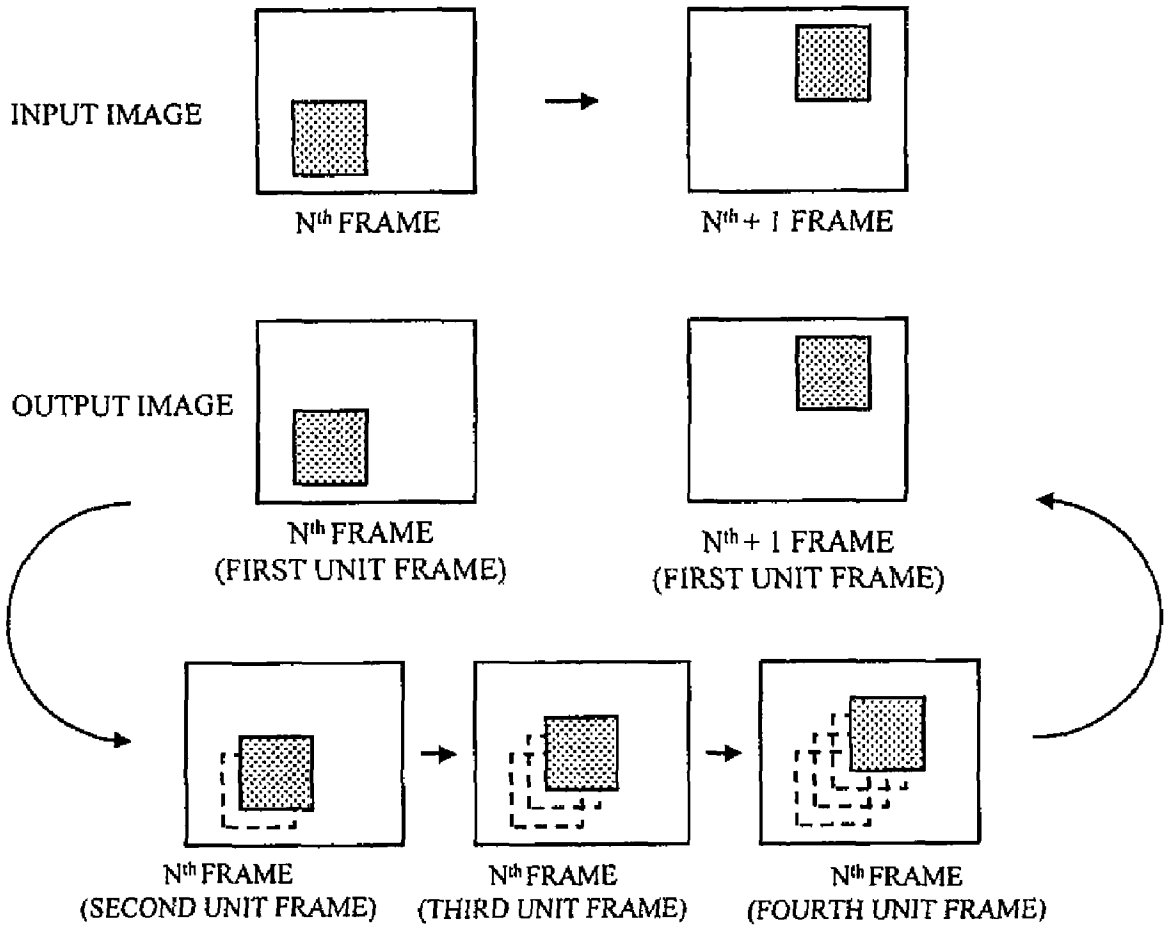
FIG. 9 shows displaying states according to a motion vector.

The gradation extension method as described above is effective in increasing low-brightness gradation. In the case of low brightness, as flicker and a pseudo contour are not prominent because it is dark, it is not necessary to increase the speed up to 4× speed. Further, the moving image displaying performance can be improved by way of 4×-speed driving. As shown in FIG. 9, it is assumed that an input image is input at 60 Hz for example and a rectangle located at the lower left of the screen in the $n^{th}$ frame is moved to the upper right of the screen in the $n+1^{th}$ frame. A motion vector is detected from the $n^{th}$ frame and the $n+1^{th}$ frame, and by 4×-speed driving, images produced based on the motion vector are inserted into the second, third and fourth unit frames. For example, if the vector is (x, y), an image of the rectangle transferred by (x/4, y/4) from the first unit frame ($n^{th}$ frame) is inserted into the second unit frame, an image of the rectangle transferred by (x/2, y/2) is inserted into the third unit frame, and an image of the rectangle transferred by (3*x/4, 3*y/4) is inserted into the fourth unit frame. With those images being inserted, movement of the rectangle is shown smoothly, whereby the moving image displaying performance is improved. If the image does not change between the $n^{th}$ frame and the $n+1^{th}$ frame, the motion vector becomes (0, 0), and the same image as that of the $n^{th}$ frame is shown in the second, third, and fourth unit frames. In other words, complementary frames are inserted into the second, third, and fourth sub-frames only when the image moves. All of the complementary frames are not necessarily the same for the first, second, third, and fourth frames. The same $n^{th}$ frame image can be inserted in the first and second unit frames, and a complementary image calculated according to the motion vector (x/2, y/2) can be inserted in the third and fourth frames. In the case of performing motion complementation, the frame rate of the output image is preferably of integral multiples such as 3× speed and 4× speed for smoothly displaying the image.

As a response of liquid crystal is as slow as tens of ms in a liquid crystal display, even if an image is updated at a high speed such as 4× speed, a response of the liquid crystal cannot keep up with the speed and a complementary image is not reflected on the display, so that an effect of improving the moving image is small. In contrast, in the case of organic EL, as a response speed is extremely high, as much as several μs, such a complementary image can be sufficiently reflected on the display even if it is rewritten at 4× speed. As such, in an organic EL display which is digitally driven, when an image is updated at 4× speed, a pseudo contour which can be caused when the image is still can be suppressed, and also the display performance of the moving image can be improved.

The features of the present invention as described above are applicable not only to organic EL displays but also to digitally-driven self-emissive displays having relatively higher responses such as plasma displays, field-emission displays, and inorganic EL displays.

The invention has been described in detail with particular reference to certain preferred embodiments thereof, but it will be understood that variations and modifications can be effected within the spirit and scope of the invention.

PARTS LIST

1 pixels
1-1 subpixel
1-2 subpixel
1-3 subpixel
2 pixel array
3 multiplexer
4 gate drive
5 data driver
5-1 input circuit
5-2 frame memory
5-3 output circuit
6 gate lines
7 data lines
7-1 data line
7-2 data line
7-3 data line
8 power supply line
8-1 power supply line
8-2 power supply line
8-3 power supply line
9 cathode electrode
10 organic EL element
11 driving transistor
12 selection transistor
13 storage capacitance
Parts List cont'd
101 display device
102 display device
103 subpixel

The invention claimed is:

1. An organic EL display for displaying a frame having reduced pseudo contour, comprising:

(a) a plurality of pixels, each including a driving transistor, an organic EL element driven by the driving transistor, and a storage capacitance connected to the driving transistor;

(b) a plurality of gate lines, each connected to one or more corresponding pixel(s), a plurality of data lines, each connected to one or more corresponding pixel(s), a gate driver for selectively driving the plurality of gate lines, and a data driver for selectively driving the plurality of data lines, wherein each pixel is connected to a single data line and to a single gate line, the gate driver selects one gate line at a time, and pixel data from the data driver on a single data line is written to the storage capacitance in the pixel connected to the single data line and to the selected gate line;

wherein pixel data includes an off-potential or an on-potential, so that on-potential pixel data written to a pixel causes the corresponding organic EL element to emit light, and off-potential pixel data written to a pixel causes the light emission from the corresponding organic EL element to be extinguished;

and wherein the storage capacitance causes the one or more organic EL element(s) in pixels attached to non-selected gate lines to maintain their respective light emission state(s);

(c) a frame memory for storing pixel data corresponding to one frame and providing the stored pixel data to the data driver; and (d) means for operating the gate driver and the data driver to display the stored pixel data corresponding to one frame in a plurality of successive unit frames, each including a corresponding plurality of successive sub-frames, wherein each unit frame repeatedly displays the same image, has the same frame period and has a number of sub-frames greater than or equal to a respective bit gradation number, and wherein each sub-frame corresponds to a bit of pixel data;

whereby the one frame can be displayed with reduced false contour.

2. The organic EL display of claim 1, further including:

(e) means for receiving a first and a second frame and detecting a motion vector from the first and second frames; and (f) means for producing complementary frame images based on the first and second frames and the motion vector;

wherein a single complementary frame image is displayed in a corresponding unit frame of the first frame.

3. The organic EL display of claim 1, wherein each pixel further includes two or more sub-pixels, each having a driving transistor, an organic EL element driven by the driving transistor, and a storage capacitance connected to the driving transistor.

4. The organic EL display of claim 3, wherein the organic EL element in each sub-pixel has a respective luminous area, and the luminous areas of all the organic EL elements in a pixel are different.

5. The organic EL display of claim 3, further including a plurality of power source lines, each supplying a corresponding potential, wherein the driving transistor in each sub-pixel is connected to a single power source line, and the potentials of all the power source lines connected to driving transistors in a pixel are different.

6. The organic EL display of claim 1, wherein the one frame is displayed during a frame period having a frequency of 60 Hz, and wherein successive unit frames are displayed at a frequency of greater than or equal to 240 Hz.

* * * * *